United States Patent [19]

Potter

[11] 4,108,377

[45] Aug. 22, 1978

[54] NON-METALLIC-REINFORCED MOLDED CROSSTIE

[75] Inventor: Edward Potter, 14415 SW. 6th, Beaverton, Oreg. 97005

[73] Assignees: Edward Potter, Beaverton; Dant & Russell, Inc., Portland, both of Oreg.

[21] Appl. No.: 662,703

[22] Filed: Mar. 1, 1976

Related U.S. Application Data

[63] Continuation-in-part of Ser. No. 588,786, Jun. 20, 1975.

[51] Int. Cl.[2] ..... E01B 3/44

[52] U.S. Cl. ..... 238/91; 238/84

[58] Field of Search ..... 238/91, 85, 84, 83; 428/526, 528, 529, 535

[56] References Cited

U.S. PATENT DOCUMENTS

| | | | |
|---|---|---|---|
| 2,082,399 | 6/1937 | Isman et al. | 238/83 X |
| 2,128,530 | 8/1938 | Hadley | 238/91 |
| 2,847,733 | 8/1958 | Roy | 428/528 |
| 3,054,706 | 9/1962 | Glaubert | 428/528 |
| 3,096,297 | 7/1963 | Peterkin | 428/528 |
| 3,309,444 | 3/1967 | Schueler | 238/83 |
| 3,908,902 | 9/1975 | Collins et al. | 238/83 |
| 3,928,693 | 12/1975 | Rudloff | 428/528 |

*Primary Examiner*—Drayton E. Hoffman
*Assistant Examiner*—Carl Rowold
*Attorney, Agent, or Firm*—Chernoff & Vilhauer

[57] ABSTRACT

A reinforced railroad crosstie formed by molding and bonding comminuted lignocellulosic material into a monolithic beam around a plurality of wooden reinforcing members which have relatively clear and straight grain, a high modulus of rupture and a high modulus of elasticity and are able to withstand a high amount of compression without crushing. The reinforcing members are positioned within the crosstie proximate lines of maximum tensile stresses expected to be induced in the tie by different bending influences caused by passing trains and varying conditions of the underlying ballast. The members are also positioned within the crosstie so as to avoid interference with the spikes employed to fasten the rail to the tie.

16 Claims, 6 Drawing Figures

NON-METALLIC-REINFORCED MOLDED CROSSTIE

CROSS-REFERENCE TO OTHER APPLICATION

This application is a continuation-in-part of my copending application, Ser. No. 588,786, filed June 20, 1975.

BACKGROUND OF THE INVENTION

The present invention relates to a railway cross-tie of molded and bonded lignocellulosic material internally reinforced against positive and negative bending stresses expected from train movements over a railway track. Most conventional railway crossties used in this country today are lumber beams, approximately 7 inches thick by 9 inches wide by 8½ or 9 feet long, that have been cut from sections of live tree trunks selected to be free from soft or decayed spots, shakes, worm holes, and other imperfections. Before being placed into service as crossties, these beams are treated with creosote, an oily liquid preservative, to protect them against the effects of exposure to the elements.

The major disadvantages of using lumber beams for railway crossties are the ever-increasing costs of raw lumber, the difficulty of applying creosote with sufficient penetration to prevent rapid deterioration of the beams, and the need continually to replace and dispose of those beams that are split, rotted and worn. As an example of this latter problem it has been reported that the Santa Fe Railroad alone uses approximately 1.6 million lumber crossties annually. A few of these ties are subsequently sold to farmers and ranchers along the railway right-of-way, but most must be buried underground as current ecological considerations prohibit their being burned in the open or left along the right-of-way for extended periods of time.

Previous attempts have been made to develop a substitute for the conventional wooden crosstie, such as by manufacturing crossties from synthetic resins as shown in Groff U.S. Pat. No. 3,289,940, or from concrete, steel or thin particle board sheets made from recycled ties or other lignocellulosic materials and laminated together. These attempts have not been successful, however, due to the higher costs of the substitute crossties, lack of sufficient strength and durability in some cases to withstand the cyclic bending and vibratory loads peculiar to crossties, lack of hardness and undue susceptibility to tie plate wear, non-adaptability of such substitute materials to the use of conventional rail-fastening spikes, inability to hold such spikes in place under normal service, and, in the case of the metal substitutes, electrical conductivity of the material employed. (Since the metal rails fastened to the ties to form the railway are also often utilized as electrical conductors for the railway signal system, it is imperative that the crossties be electrically nonconductive so not to create an electrical circuit between the rails and thereby disrupt the signalling system.)

One approach to overcoming the aforementioned problems of conventional railway ties produced from raw lumber, and the aforementioned types of substitute crossties, has achieved success by the use of a mixture of comminuted lignocellulosic material bonded together and molded in the form of a highly densified, thick monolithic beam, having the dimensions of a conventional lumber railway crosstie, around a plurality of elongate metal reinforcing rods, as described in my copending patent application entitled "Reinforced Molded Crosstie and Method for Making Same", Ser. No. 588,786, filed June 20, 1975, herein incorporated in its entirety by reference. Such highly densified synthetic crossties provide an economical, electrically nonconductive substitute for the conventional wooden railway crosstie and have good resistance to decay, stress and wear and excellent spike-holding qualities. The bond between the metal reinforcing rods and the lignocellulosic material is considerably enhanced by lateral protrusions attached along the rods to prevent slippage. However the metal used to produce the elongate reinforcing members and the lateral protrusions add a certain amount to the cost of production which would be desirable to eliminate if possible. Also, the positioning of the spikes used to fasten the rails to the ties is somewhat critical if interference with the signalling system is to be avoided since they cannot touch the conductive metal reinforcing members.

Another approach to overcoming the problems of conventional railway crossties is suggested in Collins et al U.S. Pat. No. 3,908,902 wherein railway ties are molded from a mixture of comminuted material and a binder, and slabs of wood are included in the mix for reinforcement. Although the use of such wood slabs may tend to increase the strength of such crossties and reduce the reinforcing cost and the problem of interference with the signalling system, the Collins et al ties are produced at the relatively low pressure of only 300–800 psi which would indicate low resistance to stress, vibration and wear and low-spike holding qualities. Higher pressure would crush most common wood reinforcing material during the tie manufacturing process, rendering it ineffective. Also, the arbitrary placement of wooden slabs in such a tie as reinforcing material may fail to maximize the tie's resistance to the particular types of bending stresses to which railway crossties are typically subjected.

Accordingly, a need exists for an economical reinforced molded railway tie utilizing lignocellulosic particles which has excellent resistance to decay, stress and wear and excellent spike-holding qualities, and utilizes a reinforcing material which can withstand high compressive force without crushing, is less expensive than metal and produces a molded crosstie which is stronger than that produced by metal reinforcing. Also, it is desirable to reduce the criticality of the placement of reinforcing members in such a tie with respect to the spikes while utilizing the placement of the reinforcing members to maximize the tie's resistance to special tie bending stresses.

SUMMARY OF THE INVENTION

The present invention is directed to a reinforced, molded substitute for the conventional wooden railway crosstie which satisfies the foregoing requirements. More particularly, the crosstie of the present invention utilizes a plurality of particularly strong, elongate wooden reinforcing members selectively placed in a mixture of comminuted lignocellulosic material bonded together and molded under high pressure and with substantial densification in the form of a thick monolithic beam having the dimensions required for railway crossties.

Preferably the lignocellolosic material used to mold the beam is comminuted wood from old worn wooden ties which may contain rotted portions rendering the ties no longer resistant to normal railway stress, and may include the rotted as well as the sound wood portions. However, other suitable lignocellulosic materials including but not limited to hardwood or softwood chips, shavings, sawdust and barks, bagasse, straw, rice hulls, corn stalks, reeds, vegetable stems, cork and the like, or mixtures thereof, are also contemplated for use in various proportions depending upon their fibrous characteristics and the required resistance of the finished crosstie to bending-induced tensile stresses. If a substantial proportion of the lignocellulosic material is composed of comminuted reclaimed ties, it may be necessary to add little or no additional creosote when the new ties are formed as the creosote already in the wood of the old ties may be sufficient to protect the new tie from the effects of exposure. Regardless of the source of the creosote, a monolithic tie of the present invention made from comminuted creosoted lignocellulosic particles will be substantially more resistant to rotting from exposure to the elements since the creosote will be homogeneously mixed throughout the new tie rather than concentrated adjacent the surface only, as is the case with conventional lumber ties.

A particularly efficient mechanical process for converting comminuted lignocellulosic material into the thick, highly densified rigid form of the present invention is described in Edward Potter et al U.S. Pat. No. 3,804,935, issued Apr. 16, 1974 which is incorporated herein in its entirety by this reference. Thermoplastic or thermosetting resin binders of any known suitable type, or preferably a mixture of both, may be utilized as the bonding agent with the lignocellulosic particles constituting 75% or more by weight of the particle and binder mixture, and preferably more than 80% by weight. A densifying pressure of at least 1,200 psi, and preferably more than 2,000 psi, should be utilized to densify the material to at least about four times and preferably at least five times its uncompressed density, thereby resulting in a final density in the range of about 35-80 lbs/ft$^3$ depending upon the type of lignocellulosic material utilized, and to form the material to thickness, width and length dimensions at least as great as those of a conventional wooden railway crosstie to produce a monolithic (rather than laminated) tie. It is preferred that the densifying pressure used be more than 2,000 psi in order to obtain a greater density, which makes the tie harder and therefore more wear-resistant than lumber ties and provides it with better spike-holding characteristics and resistance to vibration due to the high internal pressure of the bonded lignocellulosic material, the latter being particularly advantageous in the use of conventional spikes to fasten the rails to the tie.

The reinforcing is achieved by the use of elongate wooden members (or other non-metallic elongate reinforcing members made from such substances as high-strength organic polymers) having a tensile strength and modulus of elasticity greater than that of the bonded particle matrix in which they are embedded, and placed in the molded tie to extend lengthwise proximate the upper and lower surfaces of the tie on either side of the neutral bending axis. Thus positioned, the reinforcing members are proximate and parallel to the different lines of maximum tensile stress that will be induced within the tie when it is subjected to the downward forces of a passing train, as will be explained in detail hereafter. The reinforcing members are also located generally in a vertical plane passing through the longitudinal center of the tie, thereby enabling the spikes which fasten the rail to the tie to be driven into the tie on either side of its longitudinal center, as is the convention, without damaging or being obstructed by the wooden reinforcing members within the tie. Although this positioning is desirable, it is not as critical as with the use of metal reinforcing rods since the wood is non-conductive and thus the metal spikes may come in contact with the wooden reinforcing members without producing an electrical path between the two rails which would interfere with a railway signalling system utilizing the two rails as electrical signal conductors.

The wood or other non-metallic material utilized for the elongate reinforcing members should be characterized by a high enough density to resist without fracture the crushing forces of at least 1,200 psi and preferably more than 2,000 psi in a direction transverse to the length of the member (transverse to the grain in the case of wood) to which the tie is subjected during production, a high modulus of rupture, of at least about 13,000 psi, to prevent breakage during bending of the tie, and a high modulus of elasticity, on the order of at least about 1,800,000 psi, to provide substantial stiffness necessary to resist such bending during the cyclical loading to which the tie is subjected. Moreover the wooden members should have relatively clear, that is, knot-free, straight grain to avoid concentrations of stress which might lead to breakage.

Most wood is unsatisfactory as reinforcing material in such a tie because it lacks the aforementioned characteristics, particularly the necessary crush-resistance transverse to the grain. However, it has been found that timber species of the genus Dipterocarpus are particulary suitable for use as a reinforcing material in such railway ties and particularly ties produced at the preferable molding pressure of more than 2000 psi. Such wood is generally found in Asia and is usually marketed as "yang" in Thailand, "apitong" in the Philippine Islands, "gurjun" in India and Burma and "keruing" in Malaysia and Indonesia, to list a few of its common names. Hardwood species having similar properties can also be found in Central and South America and Africa. It is also recognized that limited other types of wood such as some types of oak or birch might also be used if they have the aforementioned characteristics and are sorted to find adequately clean pieces.

Surrounding the sides, ends and bottom of each tie when installed in a conventional railway is a ballast of crushed rock or gravel that serves as a supportive surface to spread the load of a passing train over the earthen subgrade below the railway, hold the tracks and ties in position, and act as a drainage system. Over a period of time, this ballast will tend to loosen and deteriorate in supportive capability under the repeated pounding of passing trains, leaving the tie relatively unsupported at some points along its length. If the ballast deteriorates near the ends of the tie, downward pressure exerted against the rails by the wheels of passing trains will cause the ends of the tie to flex downwardly about a fulcrum formed by the ballast at the middle of the railway, thereby bowing the center of the tie upwardly and creating a point of maximum tensile stress in the upper surface of the tie approximately midway between the two rails. Since the bond created between wooden reinforcing members of the type described and the lignocellulosic material is relatively strong and continuous throughout the length of the reinforcing member, the wooden reinforcing member may be placed near the top surface of the tie to resist such stress without the use of radially extending protrusions or localized stress concentrations to prevent sliding of the lignocellulosic material relative to the reinforcing member as is necessary with metal reinforcing.

Conversely, if the ballast material is loosened along the underside of the tie directly below either of the rails, the downward force exerted by passing trains will cause the tie to bow downwardly under that rail, creating a point of maximum tensile stress in the lower surface of the tie directly below the rail. Accordingly the placement of such a wooden reinforcing member near the lower surface of the tie will likewise prevent a stress build-up within the tie sufficient to cause cracking across the bottom of the tie. Thus, by placing elongate wooden reinforcing members of the type described longitudinally within the tie approximate the lines of maximum expected stress, i.e., above and below the neutral bending axis of the tie, the lignocellulosic material of the tie is reinforced against the positive and negative bending forces expected to be encountered by railway ties under the varying ballast conditions. Moreover, due primarily to the good bonding that can be achieved between the wooden reinforcing members and the lignocellulosic material throughout the entire length of the reinforcing members, greater strength can be achieved in such a molded tie using wooden reinforcing members than with the use of metal reinforcing members, and it has been found that the use of wood is less expensive than the use of metal reinforcing.

It is, therefore, a principal objective of the present invention to provide a reinforced substitute for a conventional lumber railway tie, molded from lignocellulosic waste products and a binder, which is exceptionally strong and economical and not likely to interfere with the electrical signalling system of a conventional railway; and which has excellent resistance to decay, stress and wear, and good spike-holding qualities and preferably exceeds conventional lumber ties with respect to these characteristics.

It is a principal feature of the present invention to utilize selectively-placed elongate non-metallic reinforcing members in such a substitute tie wherein such non-metallic members are characterized by an exceptionally high resistance to crushing in a direction transverse to their length combined with a substantial tensile strength and modulus of elasticity.

The foregoing objectives, features and advantages of the present invention will be more readily understood upon consideration of the following detailed description of the invention taken in conjunction with the accompanying drawings.

DETAILED DESCRIPTION OF THE INVENTION

Referring to the figures, the reinforced railway crosstie of the present invention, indicated generally at 20, is seen to comprise a mixture of comminuted lignocellulosic material 22 bonded by an adhesive binder into the form of a beam 24 around a pair of elongate wooden reinforcing members 26 and 28 having a higher tensile strength and modulus of elasticity (Young's modulus) than the bonded mixture 22. The lignocellulosic mixture 22 is composed preferably of comminuted wood from old rotted, worn or split railway ties; however, other fibrous vegetable waste materials may be used alone or in mixtures. Suitable thermosetting and/or thermoplastic binders in sufficient quantities to ensure the formation of a relatively hard, rigid product, for example as taught by the aforemetioned Potter et al U.S. Pat. No. 3,804,935, are mixed with the lignocellulosic materials before they are molded around the wooden reinforcing members 26 and 28. To provide a sufficiently economical product the lignocellulosic materials should comprise at least 75% by weight of the mixture of lignocellulosic particles and binder, and preferably in the range of about 85% to 92%. The mold in which the beam is to be formed should define an interior enclosure, after compression of the lignocellulosic material and locking of the mold, having thickness, width and length dimensions at least as great as those of a conventional lumber crosstie. If desired, molds with lengths longer than a conventional crosstie may be used and the beams produced therein sawed into shorter lengths. The sides of the mold should be tall enough to hold a sufficient volume of uncompressed material to achieve the previously described degree of densification upon compression. Hardening of the binders used, by curing of a thermosetting binder with or without heat, or heating and subsequent cooling of a thermoplastic binder, are carried out in the mold.

Figure 2:
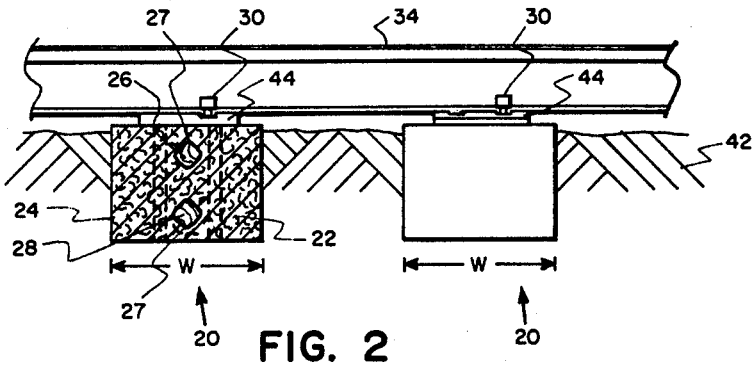
FIG. 2 is an end view of two reinforced railway ties of the present invention, installed as components of a conventional railway, with one tie sectioned along line 2—2 of FIG. 1.

The elongate reinforcing members 26 and 28 are made of wood with the grain of the wood preferably running along the longitudinal dimension thereof. The cross section of the reinforcing members may be any convenient shape, for example a square 1 ½ inches on each side, but where a square shape is used it should be oriented with diagonally opposed edges in substantially horizontal and vertical planes respectively as shown in FIG. 2 to provide maximum resistance to bending, and the topmost and bottommost edges 27 should be slightly rounded or beveled to prevent stress concentrations and resultant cutting of the reinforcing member through the bonded lignocellulosic material 22. A satisfactory crosstie can be made with the application of 1,200 psi or more during the molding process, and the wood or other material used to make the reinforcing members 26, 28 must be able to withstand such pressure applied in a direction transverse to the length and grain, as the case may be, without failing by fracture; however, a much better crosstie surprisingly having more resistance to wear and stress and better spike-holding qualities than lumber ties can be made by the application of pressure greater than 2,000 psi, and it is therefore preferred that the reinforcing wood or other material be able to withstand more than 2,000 psi transverse to the length and grain without failing by fracture. Such material will have a relatively clear, straight grain in the case of wood, a high modulus of rupture (at least about 13,000 psi) and a high modulus of elasticity (on the order of at least 1,800,000 psi).

Wood species of the genus Dipterocarpus, found generally in Asia, are particularly suitable for use as reinforcing members in the foregoing application, including those woods marketed by the names "apitong", "keruing", "yang", "gurjun", and others, and comparable woods found in Central and South America and in Africa, all of which are collectively referred to herein in the specification and claims as "apitong". Other woods satisfying the foregoing mechanical requirements are also likely to be suitable.

Figure 1:
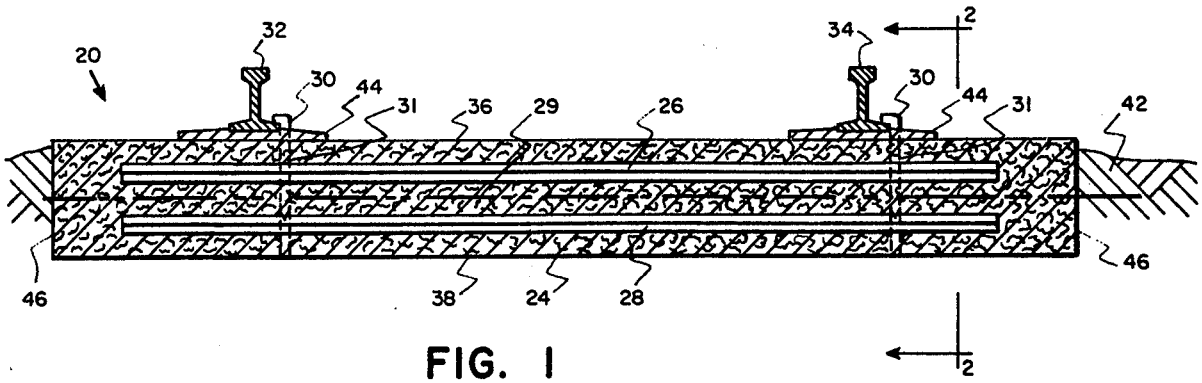
FIG. 1 is a sectional side elevation of the reinforced railway tie of the present invention shown in place as a component of a conventional railway.

During the filling of the mold with the mixture of lignocellulosic material and binders, the elongate reinforcing members 26 and 28 are placed in position and the mixture poured around them by any convenient method such that, after final compression and locking of the mold, the members are positioned within the mixture 22 in the locations shown in FIGS. 1 and 2. In order to maximize the strength of the finished tie by increasing the bond between the reinforcing members and the molded material, the members should be precoated with the binder resin utilized to bond the lignocellulosic particles together prior to placement of the reinforcing members in the mold.

The crosstie should be molded in the same orientation as shown in FIGS. 1 and 2, with the width dimension "*w*" parallel to the base of the mold, in which case a relatively thin first course of mixture is spread evenly on the base of the mold, the lower member 28 is laid atop the first course, and covered by a relatively thick second course; thereafter the upper member 26 is laid atop the second course, and covered by a relatively thin final course. This orientation of the tie in the mold is important to produce high surface hardness of the upper and lower tie surfaces so as to resist tie plate wear, since the direction of pressure application will thereby be perpendicular to these surfaces and cause flattening of the lignocellulosic fibers along planes parallel to these surfaces.

With respect to FIGS. 1 and 2 which show a finished crosstie 24, the reinforcing members 26 and 28 are positioned with one member vertically above the other generally in a vertical plane passing through the midpoint of the tie width dimension "*w*", so as not to interfere with the spikes 30 employed to fasten the rails 32 and 34 to the crosstie as described below. In addition, upper reinforcing member 26 and lower reinforcing member 28 are positioned above and below the neutral beam bending axis 29 at locations proximate the crosstie's top surface 36 and bottom surface 38, respectively, so as to lie as close as possible to the lines of maximum tensile stress that will be induced into the beam when it is subjected to positive and negative vertical bending forces.

To form a railway, the reinforced crossties of the present invention are laid side by side as indicated in FIG. 2, with their width dimensions "*w*" oriented horizontally over a supportive surface, for example, a layer of ballast 42 composed of cinders or crushed stone. This ballast completely surrounds each tie up to the level of its top surface 36 to spread the load of the railway over the earthen subgrade, hold the railway in position, and act as a drainage system. The rails 32 and 34 are attached to the ties by spikes 30 inserted through holes in a metal tie plate 44 and driven into the tie as with conventional wooden ties. The ties are normally pre-bored by means of bore-holes such as 31 to receive the spikes, thereby minimizing the risk of splitting the tie. Normally, two spikes 30 are employed to attach a rail to a tie, the spikes being driven into the tie on either side of the rail at points on either side of the midpoint of the width dimension "*w*" as shown in the figures. As the wooden reinforcing members 26 and 28 are positioned within beam 24 one above the other at such midpoint the spikes 30, when driven in their conventional locations, will pass on either side of the reinforcing rods without substantial interference therewith. This enables the use of conventional rail spikes in the bonded material, which has been sufficiently densified to receive and hold them, by ensuring that they will not be obstructed by or damage the reinforcing members.

Figure 3:
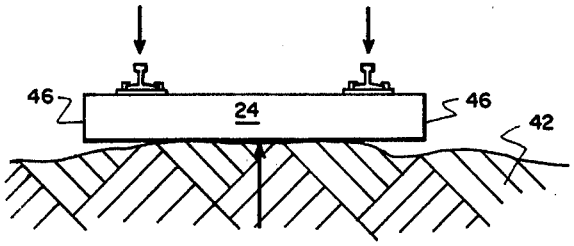
FIG. 3 is a simplified side view of an exemplary tie depicting, in exaggerated form, the underlying ballast in a deteriorated condition adjacent the ends of the tie and the resultant force vectors directed against the tie.
Figure 4:
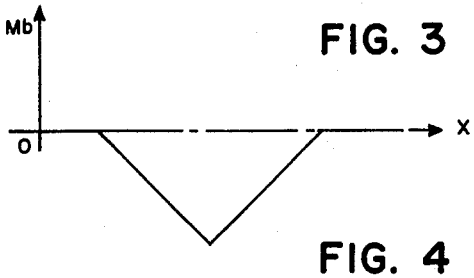
FIG. 4 is a diagram indicating the negative bending moments exerted by the weight of a train on the exemplary tie of FIG. 3.

After repeated pounding by the wheels of passing trains against the rails and ties of the railway, the ballast 42 packed around the ties may begin to loosen in certain locations, thereby removing a portion of the tie's support and subjecting it to beam loading. When the ballast loosens near the ends 46 of the tie, as depicted in FIG. 3, the downward forces exerted by passing trains will thereafter cause the ends of the tie to bow downwardly about its middle creating a bending moment diagram roughly as shown in FIG. 4 with a maximum negative bending moment at approximately the midpoint of the tie inducing a resultant maximum tensile stress in the upper surface 36 of the tie at the same point. The location of the upper reinforcing member above the neutral bending axis 29 and near the upper surface 36 of the crosstie 24, ensures that a substantial proportion of the tensile stress induced within the lignocellulosic material from the negative bending will be transferred to the reinforcing member, which is prevented from slipping longitudinally relative to the lignocellulosic material by the strong adhesive bond created by the binder between the wooden reinforcing material and the lignocellulosic material throughout the length of the reinforcing member.

Figure 5:
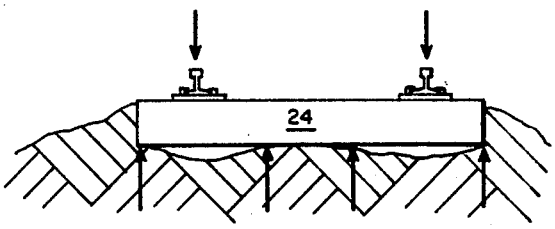
FIG. 5 is a simplified side view of an exemplary tie depicting, in exaggerated form, the underlying ballast in a deteriorated condition beneath each rail and the resultant force vectors directed against the tie.
Figure 6:
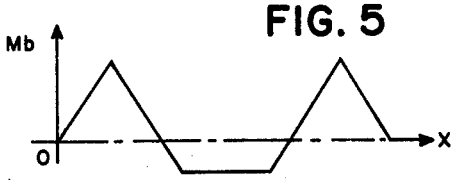
FIG. 6 is a diagram indicating the predominantly positive bending moments exerted by the weight of a train on the exemplary tie of FIG. 5.

If the repeated pounding of passing trains causes the ballast 42 to loosen around the lower surface of the tie directly below one or both of the rails, as depicted in FIG. 5, without also loosening at the adjacent end of the tie, the downward force exerted by the train against the rail will thereafter cause the tie to bow downwardly beneath the rail, creating a bending moment diagram roughly as shown in FIG. 6 and inducing a point of maximum tensile stress in the lower surface 38 of the beam directly below the rail. As before, the location of the reinforcing member 28 below the neutral bending axis 29, and the strong bond between the reinforcing member and the lignocellulosic material, ensure that a substantial amount of the tensile stress induced within the lower surface 38 of the tie will be transferred to the reinforcing member, thereby preventing a stress buildup sufficient to cause cracking of the tie.

The terms and expressions which have been employed in the foregoing abstract and specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A reinforced railway crosstie comprising a mixture of comminuted lignocellulosic material and binder densified under pressure of at least 1,200 psi and bonded together as densified in the form of an elongate monolithic railway crosstie beam having horizontally-extending length and width dimensions and a vertically-extending thickness dimension, and elongate reinforcing means for strengthening and stiffening said crosstie against bending stress positioned longitudinally within said beam, said reinforcing means being made of wood having substantially straight, clear grain running parallel to the length dimension of said beam, said wood having a tensile strength and modulus of elasticity greater than that of said bonded mixture and being able to withstand compression of at least 1,200 psi applied in a direction transverse to said grain without fracture.

2. The railway crosstie of claim 21 wherein said reinforcing means includes a plurality of elongate reinforcing members longitudinally positioned within said beam, at least one of said reinforcing members being located above the neutral bending axis of said beam and at least one of said reinforcing members being located below said neutral bending axis.

3. The railway crosstie of claim 1 wherein said lignocellulosic material constitutes at least 75% by weight of said bonded mixture.

4. The railway crosstie of claim 3 wherein said lignocellulosic material comprises in the range of about 85% to 92% by weight of said bonded mixture.

5. The railway crosstie of claim 1 wherein said crosstie has means defining a plurality of empty bore holes proximate each end extending from a surface thereof into said crosstie generally in the direction of said thickness dimension for receiving and tightly holding spikes employed to attach a rail to said crosstie.

6. The railway crosstie of claim 5 wherein said reinforcing means includes a plurality of elongate reinforcing members longitudinally positioned within said beam one above the other at about the midpoint of said width dimension, said holes being spaced laterally on either side of said reinforcing members.

7. The railway crosstie of claim 1 wherein said lignocellulosic material includes comminuted particles of wood impregnated with creosote.

8. A reinforced railway crosstie comprising a mixture of comminuted lignocellulosic material and binder densified under a pressure of more than 2,000 psi and bonded together as densified in the form of an elongate monolithic railway crosstie beam having horizontally-extending length and width dimensions and a vertically-extending thickness dimension and elongate reinforcing means for strengthening and stiffening said crosstie against bending stress positioned longitudinally within said beam, said reinforcing means being made of wood having substantially straight, clear grain running parallel to the length dimension of said beam, such wood having a tensile strength and modulus of elasticity greater than that of said bonded mixture and being able to withstand compression of more than 2,000 psi applied in a direction transverse to said grain without fracture.

9. The railway crosstie of claim 1 wherein said reinforcing means has a modulus of rupture of at least about 13,000 psi, and a modulus of elasticity of at least about 1,800,000 psi.

10. The railway crosstie of claim 8 wherein said reinforcing means includes a plurality of elongate reinforcing members longitudinally positioned within said beam, at least one of said reinforcing members being located above the neutral bending axis of said beam and at least one of said reinforcing members being located below said neutral bending axis.

11. The railway crosstie of claim 8 wherein said reinforcing means has a modulus of rupture of at least about 13,000 psi, and a modulus of elasticity of at least about 1,800,000 psi.

12. The railway crosstie of claim 8 wherein said lignocellulosic material constitutes at least 75% by weight of said bonded mixture.

13. The railway crosstie of claim 12 wherein said lignocellulosic material comprises in the range of about 85% to 92% by weight of said bonded mixture.

14. The railway crosstie of claim 8 wherein said crosstie has means defining a plurality of empty bore holes proximate each end extending from a surface thereof into said crosstie generally in the direction of said thickness dimension for receiving and tightly holding spikes employed to attached a rail to said crosstie.

15. The railway crosstie of claim 14 wherein said reinforcing means includes a plurality of elongate reinforcing members longitudinally positioned within said beam one above the other at about the midpoint of said width dimension, said holes being spaced laterally on either side of said reinforcing members.

16. The railway crosstie of claim 8 wherein said lignocellulosic material includes comminuted particles of wood impregnated with creosote.

* * * * *

UNITED STATES PATENT AND TRADEMARK OFFICE

CERTIFICATE OF CORRECTION

PATENT NO. : 4,108,377

DATED : August 22, 1978

INVENTOR(S) : Edward Potter

It is certified that error appears in the above–identified patent and that said Letters Patent are hereby corrected as shown below:

Col. 9, line 17 Change "claim 21" to --claim 1--.

Col. 10, line 2 Change "dimension" to --dimension,--.

Signed and Sealed this

*Twentieth* Day of *March 1979*

[SEAL]

*Attest:*

RUTH C. MASON
*Attesting Officer*

DONALD W. BANNER
*Commissioner of Patents and Trademarks*